US009457942B2

(12) United States Patent
Mayo et al.

(10) Patent No.: US 9,457,942 B2
(45) Date of Patent: Oct. 4, 2016

(54) EXTENDED SUPPORT CLIP FOR A METAL LOCKING TIE

(71) Applicant: Panduit Corp., Tinley Park, IL (US)

(72) Inventors: Michael Mayo, New Lenox, IL (US); Rodney G. Rouleau, Manhattan, IL (US)

(73) Assignee: Panduit Corp., Tinley Park, IL (US)

( * ) Notice: Subject to any disclaimer, the term of this patent is extended or adjusted under 35 U.S.C. 154(b) by 58 days.

(21) Appl. No.: 14/266,950

(22) Filed: May 1, 2014

(65) Prior Publication Data

US 2014/0325796 A1 Nov. 6, 2014

Related U.S. Application Data

(60) Provisional application No. 61/819,940, filed on May 6, 2013.

(51) Int. Cl.
*B65D 63/08* (2006.01)
*B65D 63/00* (2006.01)

(52) U.S. Cl.
CPC ..... *B65D 63/08* (2013.01); *Y10T 24/1473* (2015.01)

(58) Field of Classification Search
CPC .... Y10T 24/1473; B65D 63/08; H02G 3/30; H02G 3/26
USPC ..... 24/136 B, 25
See application file for complete search history.

(56) References Cited

U.S. PATENT DOCUMENTS 3,421,187 A 1/1969 Ryder
3,538,553 A * 11/1970 Brucker ..... A44B 11/125 24/68 E
3,894,706 A 7/1975 Mizusawa
3,993,272 A 11/1976 Lindeman
4,189,807 A 2/1980 Byerly
4,366,602 A 1/1983 Conlon et al.
4,399,592 A * 8/1983 Chopp, Jr. ..... B65D 63/08 24/25
4,598,443 A * 7/1986 Ostling ..... F16D 1/094 24/115 M
4,779,777 A 10/1988 Johnson et al.
4,930,548 A 6/1990 Turek et al.
4,935,993 A * 6/1990 Bree ..... F16G 11/04 24/115 M
5,291,637 A * 3/1994 Meyers ..... B65D 63/08 24/136 A
5,669,110 A 9/1997 Parsons
5,690,038 A 11/1997 Merit et al.
5,732,446 A * 3/1998 Blanks ..... B65D 63/08 24/136 A
6,076,235 A * 6/2000 Khokhar ..... B65D 63/08 24/20 R
6,122,804 A * 9/2000 Gamaggio-Schafer B65D 63/06 24/20 R
6,367,745 B1 4/2002 Winton, III (Continued)

FOREIGN PATENT DOCUMENTS

EP 0211710 A1 2/1987
GB 2476672 A 6/2011

(Continued)

*Primary Examiner* — Robert J Sandy
*Assistant Examiner* — Jason W San
(74) *Attorney, Agent, or Firm* — Christopher S. Clancy; James H. Williams; Aimee McVady

(57) ABSTRACT

A metal locking tie and support clip for securing a bundle are disclosed. The metal locking tie is positioned within the support clip. The metal locking tie has a tie head and a tie body. The tie head includes a locking ball and a bottom with an opening. The tie body includes a first end and a second end with cut-off edges. The support clip supports the bottom of the tie head and encapsulates the cut-off edges of the second end of the tie body.

4 Claims, 3 Drawing Sheets

(56) References Cited

U.S. PATENT DOCUMENTS

| | | | | |
|---|---|---|---|---|
| 6,394,695 | B1 | 5/2002 | Chausset | |
| 6,477,746 | B1 * | 11/2002 | Axelsson | B65D 63/08 24/25 |
| 6,668,427 | B2 * | 12/2003 | Bulanda | B65D 63/08 24/115 L |
| 7,762,503 | B2 | 7/2010 | Franks | |
| 7,930,805 | B2 * | 4/2011 | Bulanda | B65D 63/08 24/20 R |
| 8,225,461 | B2 * | 7/2012 | Bulanda | B65D 63/08 24/21 |
| 8,800,115 | B2 * | 8/2014 | Gingell | B01J 8/0207 24/25 |
| 2003/0204936 | A1 * | 11/2003 | Caveney | B65D 63/08 24/20 EE |
| 2003/0204937 | A1 * | 11/2003 | Bulanda | B65D 63/08 24/22 |
| 2006/0200949 | A1 * | 9/2006 | Bae | B65D 63/06 24/20 R |
| 2008/0005872 | A1 * | 1/2008 | Huang | F16L 3/2338 24/20 R |
| 2012/0124783 | A1 * | 5/2012 | DeBerry | B65D 63/08 24/20 R |
| 2012/0279018 | A1 * | 11/2012 | DeBerry | B65B 13/027 24/21 |
| 2015/0143671 | A1 * | 5/2015 | Hooti | F16G 11/14 24/136 B |

FOREIGN PATENT DOCUMENTS

| | | | |
|---|---|---|---|
| WO | 8202035 | A1 | 6/1982 |
| WO | 2012154522 | A2 | 11/2012 |

* cited by examiner

EXTENDED SUPPORT CLIP FOR A METAL LOCKING TIE

CROSS REFERENCE TO RELATED APPLICATIONS

This application claims priority to U.S. Provisional Application No. 61/819,940, filed May 6, 2013, the subject matter of which is hereby incorporated by reference in its entirety.

FIELD OF THE INVENTION

The present invention relates to a metal locking tie, and more particularly, to an extended support clip for a metal locking tie.

BACKGROUND OF THE INVENTION

FIG. 1 illustrates a metal locking tie 10 with a typical tie body cut-off 24. The end of the tie body 22 is cut-off flush with the tie head 12. As a result, the sharp edges of the tie body cut-off 24 are positioned within the tie head 12.

FIG. 2 illustrates an alternative metal locking tie with an extended tie body cut-off 26. The sharp edges of the extended tie body cut-off 26 are exposed outside of the tie head 12. The exposed sharp edges could potentially injure the installer or anyone who might come into contact with the metal locking tie head 12.

As a result, it would be desirable to provide a cover for the exposed extended tie body cut-off edges to prevent injury to the end user.

SUMMARY OF THE INVENTION

The present invention is directed to a metal locking tie and a support clip. The metal locking tie is positioned within the support clip. The metal locking tie includes a tie head and a tie body. The tie head has a locking ball and a bottom with an opening. The tie body includes a first end and a second end with cut-off edges. The support clip encapsulates the cut-off edges of the second end of the tie body thereby preventing injury to the end user.

DETAILED DESCRIPTION

Figure 1:
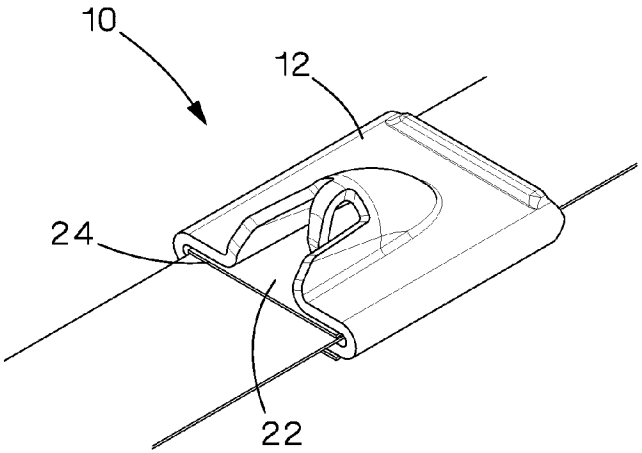
FIG.1 PRIOR ART
FIG. 1 is a partial perspective view of a metal locking tie with a standard tie body cut-off.
Figure 2:
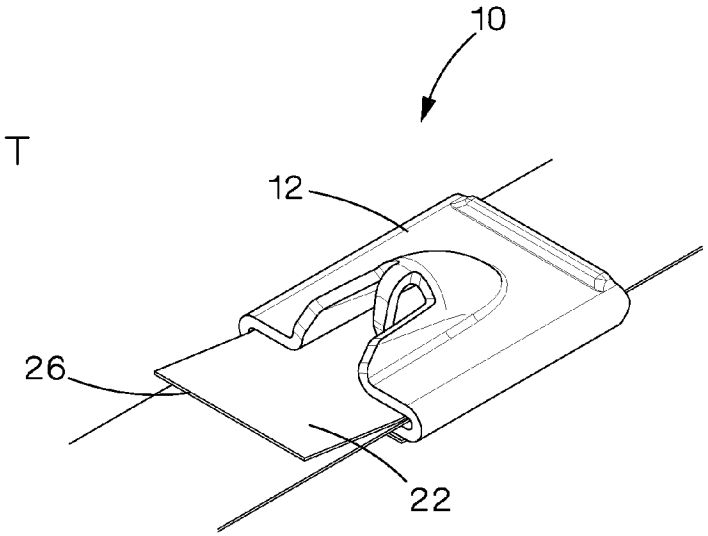
FIG.2 PRIOR ART
FIG. 2 is a partial perspective view of a metal locking tie with an extended tie body cut-off.

A metal locking tie 10 with an extended tie body cut-off 26 is necessary in applications where the metal locking tie 10 is applied over a rigid or non-compliant bundle. Once the metal locking tie 10 has been installed around the bundle, an installation tool cuts the tie body 22 at a second end 25 of the tie body 22. The tie body 22 pulls back into the tie head 12 with great speed. As a result, the locking ball 14 (see FIG. 5) in the tie head 12 requires additional tie body 22 length to compensate for the loss of the pulled back tie body before the locking ball 14 can gain the friction necessary to move into location and lock the metal locking tie.

Figure 4:
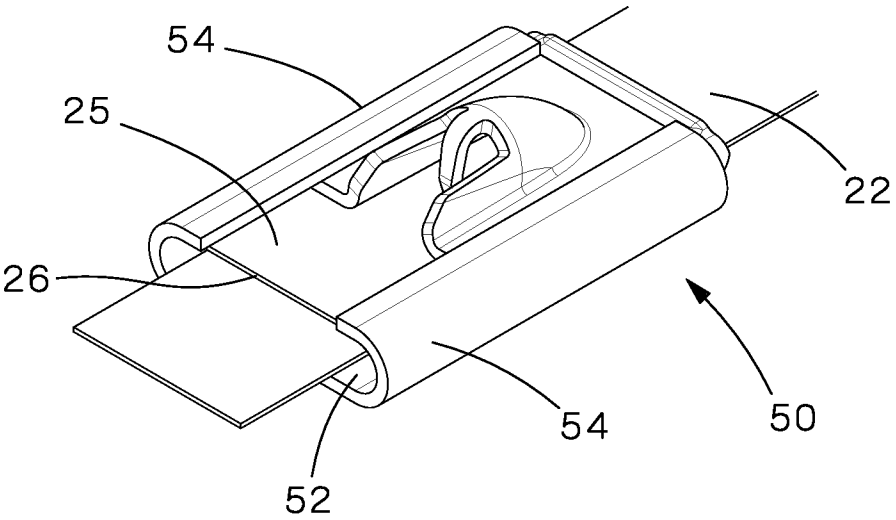
FIG. 4 is a partial perspective view of the extended support clip of FIG. 3 installed on the metal locking tie.
Figure 3:
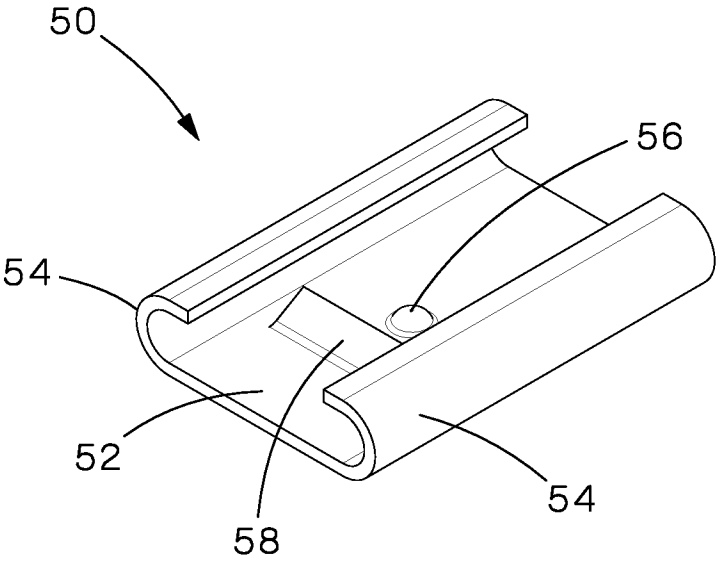
FIG. 3 is a perspective view of an extended support clip of the present invention for a metal locking tie.
Figure 5:
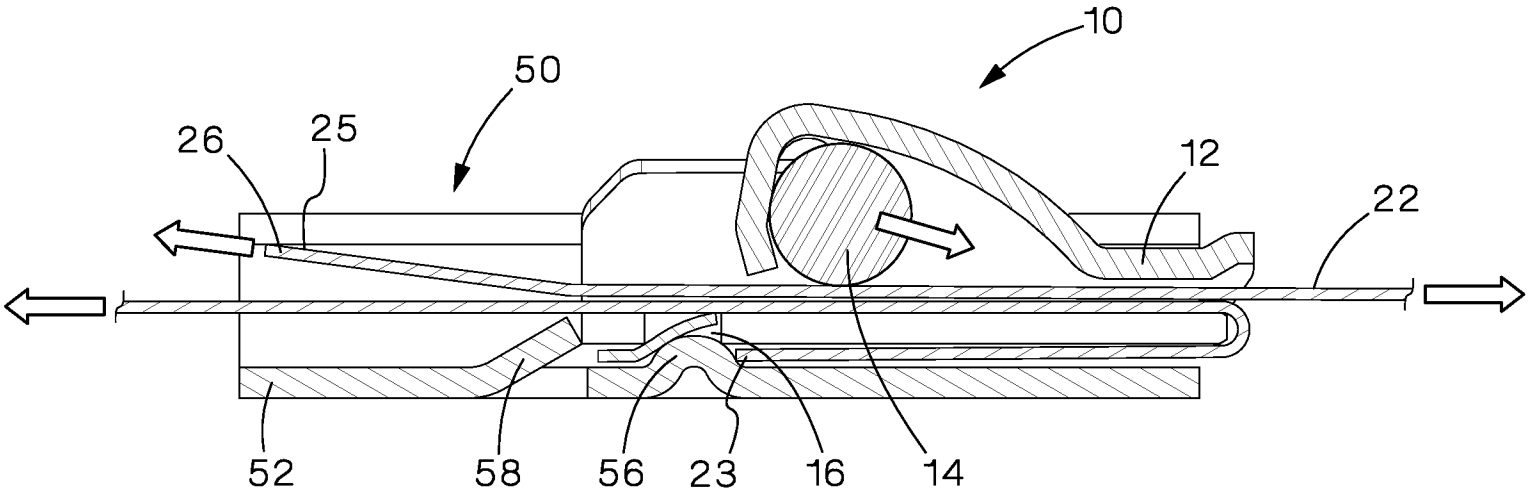
FIG. 5 is a cross sectional view of the support clip of FIG. 3 installed on the metal locking tie of FIG. 2.

FIG. 3 illustrates the support clip 50 of the present invention. The support clip 50 is designed to fit over a metal locking tie head 12 and a first end 23 of the tie body 22 of the metal locking tie 10, as illustrated in FIGS. 4 and 5. The support clip 50 may also be retrofitted on a metal locking tie 10 that has already been installed on a bundle. The support clip 50 improves the metal locking tie's tensile strength performance by providing additional rigid support to the bottom of the metal locking tie head 12.

The support clip 50 includes a bottom 52 with two C-shaped side arms 54 extending upwardly from the bottom 52 towards a center of the support clip 50. A dimple 56 extends from the bottom 52 of the support clip 50. The dimple 56 fits into a metal locking tie retention feature or opening 16 (see FIG. 5) to hold the support clip 50 in place in case of shock or vibration of the metal locking tie 10. A tensioning head support shear form 58 also extends from the bottom of the support clip 50. The shear form 58 extends upwards at an angle with respect to the bottom 52 of the support clip 50 to provide resistance to the tie head 12 during installation and tensioning of the metal locking tie 10.

As illustrated in FIGS. 4 and 5, the support clip 50 encapsulates the sharp edges of the tie body cut-off 26. The support clip 50 holds the tie body cut-off 26 in position during installation. Thus, the metal locking tie 10 with an extended support clip 50 enables the tie body cut-off 26 to be extended thereby providing the additional tie body length to properly seat the locking ball 14 within the tie head 12.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. An assembly for securing a bundle, the assembly comprising:

a metal locking tie having a tie head and a tie body, wherein the tie head including a locking ball and a locking tie retention member, and wherein the tie body including a first end located in the tie head and a second end with cut-off edges located outside the tie head; and a support clip secured to the metal locking tie, wherein the support clip fits over a bottom of the tie head and the first end of the tie body with a bottom of the support clip engaging the first end of the tie, and wherein the support clip encapsulates the cut-off edges of the second end of the tie body.

2. The assembly of claim 1, wherein the support clip includes two C-shaped side arms extending upwardly from the bottom towards a center of the support clip.

3. The assembly of claim 1, wherein the support clip includes a dimple extending from the bottom of the support clip, the dimple engages the locking tie retention member in the tie head to maintain the support clip in a stationary position.

4. The assembly of claim 1, wherein the support clip having a shear form extending from the bottom of the support clip, the shear form extending upwards at an angle to provide resistance to the tie head during installation and tensioning of the metal locking tie.

* * * * *